US006406095B1

(12) United States Patent
Bouchard et al.

(10) Patent No.: US 6,406,095 B1
(45) Date of Patent: Jun. 18, 2002

(54) SELF-LOCKING CHAIR

(75) Inventors: Jean-François Bouchard; Yvon St-Onge; Marc Laliberté, all of Québec (CA)

(73) Assignee: LPA Medical Inc., Quebec (CA)

( * ) Notice: Subject to any disclaimer, the term of this patent is extended or adjusted under 35 U.S.C. 154(b) by 0 days.

(21) Appl. No.: 09/690,452

(22) Filed: Oct. 18, 2000

Related U.S. Application Data

(60) Provisional application No. 60/160,887, filed on Oct. 22, 1999.

(51) Int. Cl.[7] ..... A47C 3/03

(52) U.S. Cl. ..... 297/281; 297/270.1; 297/282; 297/270.2

(58) Field of Search ..... 297/270.1, 270.2, 297/273, 281, 282

(56) References Cited

U.S. PATENT DOCUMENTS 170,293 A * 11/1875 Newman ..... 297/270.2
4,320,818 A 3/1982 Knoche
4,438,973 A 3/1984 LaPointe
4,623,043 A 11/1986 Babilas
5,203,433 A 4/1993 Dugas
5,358,266 A 10/1994 Roth et al.
6,106,062 A * 8/2000 Ambrose, Jr. et al. ..... 297/281
6,120,094 A * 9/2000 Parent ..... 297/281
6,244,658 B1 * 6/2001 Parent et al. ..... 297/281

* cited by examiner

*Primary Examiner*—Peter R. Brown
(74) *Attorney, Agent, or Firm*—Swabey Ogilvy Renault; Robert Mitchell

(57) ABSTRACT

A self-locking system comprising a state selector for detecting the intent of an occupant to rise from a chair and then automatically causing a lock to block the mobility functions of the chair. The state detector is responsive to movement of an upper portion of the body of the occupant while the occupant is still supported in a normal seated position on the seat of the chair, thereby advantageously allowing the locking of the mobility functions of the chair to occur before the occupant starts to lift his weight from the seat of the chair.

11 Claims, 9 Drawing Sheets

12', 10'

16'
24'
108
22'
14'
20'
18'
26'
18'
30'
18'
24'
18'

SELF-LOCKING CHAIR

This application claims benefit to U.S. provisional application Serial No. 60/160,887, filed Oct. 22, 1999.

BACKGROUND OF THE INVENTION

1. Field of the Invention

The present invention relates to mobile chairs and, more particularly, to such chairs which are lockable in a stationary position.

2. Description of the Prior Art

One problem associated with currently available mobile chairs, such as wheel chair, swivel chair, rocking chair and swinging chair, is that they do not lock in position to provide a stable support to a person which attempts to rise from the chair or sit thereon. This problem is particularly important for people who must rely onto the strength of their arms in order to get up from the chair and take place thereon.

Accordingly, it has been proposed to provide such mobile chairs with manually operated locking systems. However, the user must remember to lock the chair in a stationary position before attempting to rise or before being transferred therefrom with the help of another person. If the user or the helper forgets to activate the locking system, the chair may move backward and cause the occupant to fall. This may result in serious injuries.

A number of inventions have been proposed to overcome this problem. For instance, U.S. Pat. No. 4,623,043 issued on Nov. 18, 1986 to Babilas, U.S. Pat. No. 4,320,818 issued on Mar. 23, 1982 to Knoche, U.S. Pat. No. 4,438,973 issued on Mar. 27, 1984 to Lapointe and U.S. Pat. No. 5,203,433 issued to Dugas on April 1993 all disclose an automatic immobilizing system having an actuator operative to automatically activate a braking mechanism when a chair occupant lift is weight from a seat portion of the chair or sufficiently displace his buttock towards the front of the seat portion.

Although the automatic brake mechanism disclosed in the above mentioned patents have a common objective of automatically locking the mobility functions of the chair when an occupant attempts to rise, they all necessitate that the occupant lift his weight from the seat of the chair or at least move his buttock forward to a fore part of the seat to effect locking of the mobility functions. The fact that the stabilization of the chair only occurs after the occupant has at least partly lifted is weight from the seat of the chair i.e. when he/she is no longer in a normal sitting position, may cause the chair to move backward as the occupant is attempting to rise from the chair and, thus, may result in various injuries.

Therefore, there is still a need for a self-locking mechanism which would allow to automatically lock the mobility functions of a chair when an occupant intends to rise from the chair without the occupant having to completely or partially remove is weight from the seat portion of the chair.

SUMMARY OF THE INVENTION

It is therefore an aim of the present invention to provide a self-locking chair which automatically locks in a stationary position when an occupant intends to rise from a sitting position.

It is also an aim of the present invention to provide an improved safety device for automatically locking the mobility functions of a chair when an occupant intends to rise therefrom.

Therefore, in accordance with the present invention there is provided a self-locking system for a chair of the type having a seat and mobility functions, the self-locking system comprising a lock displaceable between idle and functional positions for selectively locking the mobility functions of the chair, and a state selector for detecting the intent of an occupant to rise from the chair and then automatically causing the lock to move to its functional position, wherein said state selector is responsive to movement of an upper portion of the body of the occupant while the occupant is still supported in a normal seated position on the seat of the chair, thereby allowing the locking of the mobility functions of the chair to occur before the occupant starts to lift his weight from the seat of the chair.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
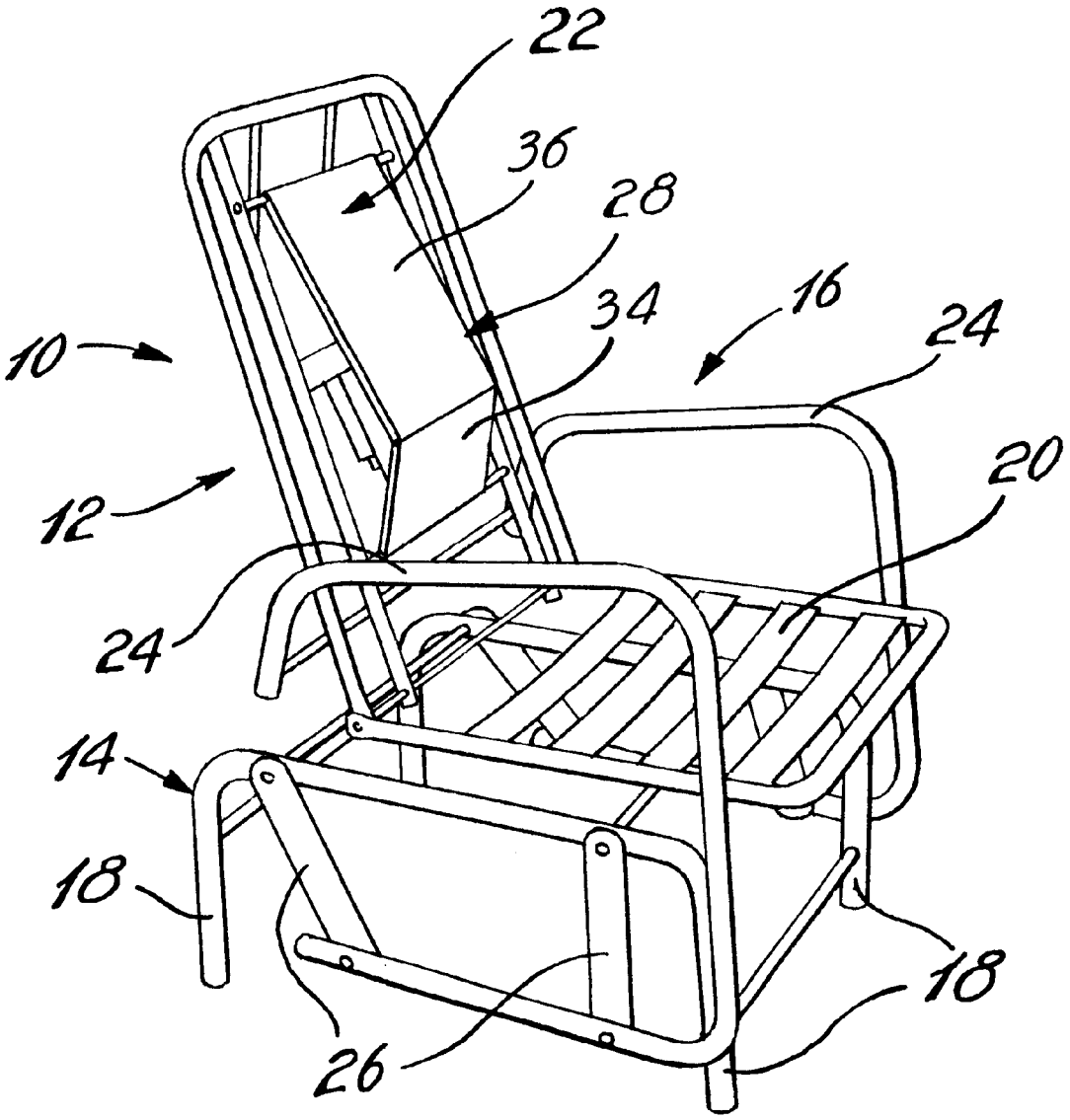
FIG. 1 is a perspective view of a swinging chair with a self-locking mechanism in accordance with a first embodiment of the present invention.

Referring now to the drawings, and more particularly to FIG. 1, there is shown a swinging chair 10 having a self-locking mechanism 12 which is adapted to automatically prevent the chair 10 from swinging when an occupant intends to rise from a sitting position, and which automatically allows the chair 10 to swing when a person sits thereon. The self-locking mechanism 12 is effective for locking the mobility functions of the chair 10 without the occupant having to completely or partially lift his weight from the chair 10. The self-locking mechanism 12 is advantageously automatically actuated while the occupant is still assuming a normal sitting position, i.e. while his buttock is still supported on a back portion of the seat of the chair, thereby ensuring a stable support for the occupant as soon as he starts lifting himself from the chair 10.

The swinging chair 10 is of conventional construction and comprises a fixed base 14 and a chair body 16. The fixed base 14 is provided in the form of a generally rectangular framework having four legs 18 depending from respective corners thereof to support the chair 10 on a support surface, such as a floor. The chair body 16 comprises a seat portion 20, a backrest portion 22 and a pair of armrests 24 rigidly mounted to opposed lateral sides of the seat portion 18. The chair body 16 is pivotally mounted to the fixed base 14 via two pairs of links 26 laterally disposed on opposed sides of the fixed base 14. Each link 26 is pivotally mounted at a first end thereof to the fixed base 14 and at a second opposed end thereof to the bottom of the armrests 24, thereby allowing the chair body 16 to rock or swing relative to the fixed base 14.

Figure 2:
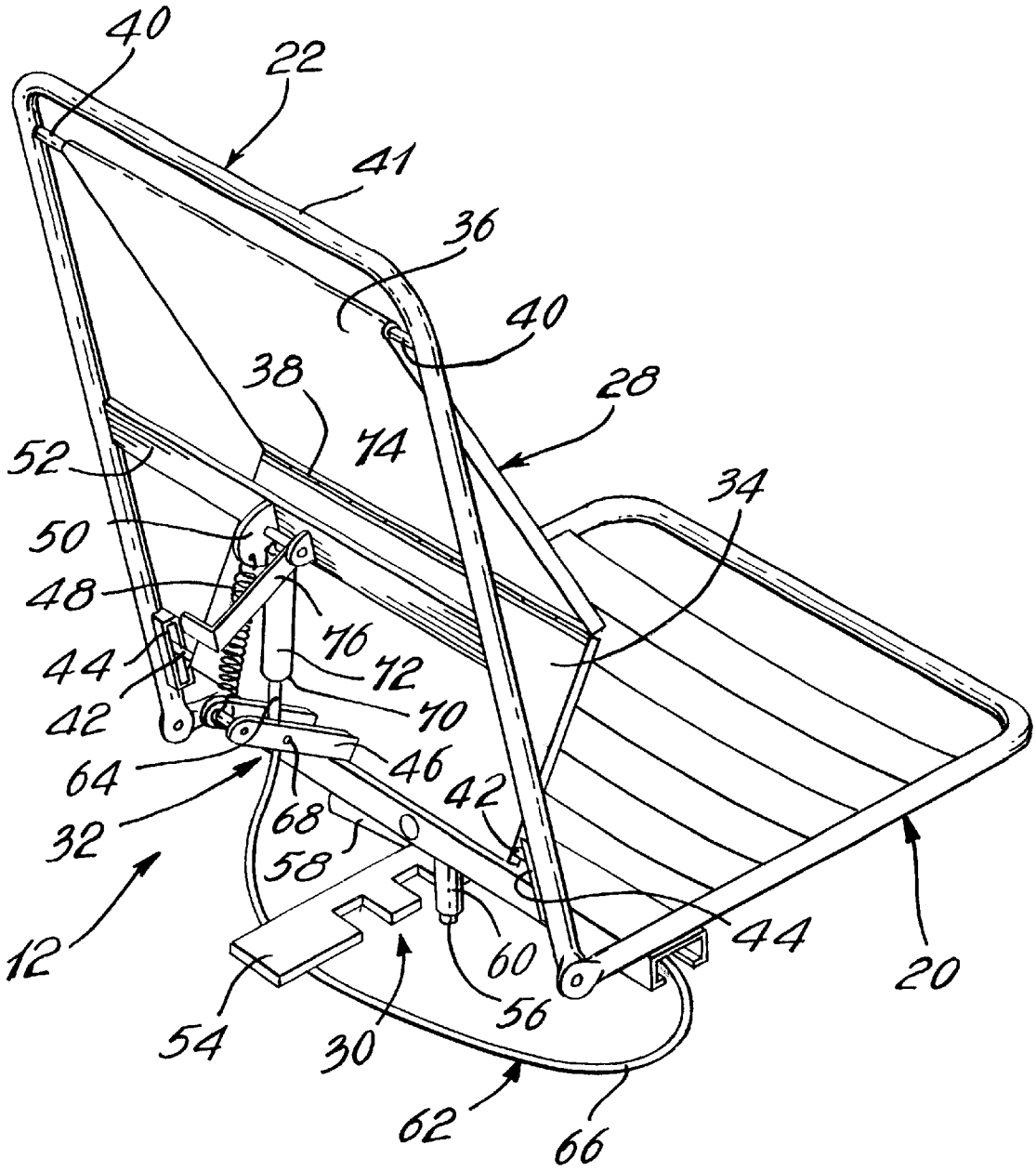
FIG. 2 is a schematic perspective view of an upper portion of the swinging chair illustrating the details of the self-locking mechanism which is partly disposed in the backrest portion of the swinging chair.

As seen in FIG. 2, the self-locking mechanism 12 generally comprises a detector 28 adapted to establish whether a person is sitting on the chair 10, a lock 30 effective for preventing relative movement between the fixed base 14 and the chair body 16, and an actuator 32 for unlocking the lock when the presence of a person on the chair 10 has been detected. The detector 28 and the actuator 32 cooperate to form an automatic release mechanism or state selector, as will be explained hereinafter.

According to the illustrated embodiment of the present invention, the detector 28 is provided in the backrest portion 22 and includes a bottom transversal plate 34 and a top transversal plate 36 hingedly connected together at adjoining edges via a hinge 38. It is noted that the top plate 36 is longer than the bottom plate 38. The top plate 36 is pivotally connected at 40 to an inverted U-shaped frame member 41 forming part of the backrest portion 22. The bottom plate 34 is provided at a bottom end portion thereof with a pair of pins 42 extending laterally outwardly from opposed sides thereof. The pins 42 are constrained to slide within guides 44 provided at the bottom of the inverted U-shaped frame member 41. A bracket 46 extends rearwardly from a bottom portion of the bottom plate 34. A spring 48 is secured at a first end thereof to a distal end portion of the bracket 46 and at a second opposed end thereof to a second bracket 50 extending rearwardly from a cross-member 52 extending transversally between the legs of the inverted U-shaped frame member 41. The spring 48 is effective for normally maintaining the top and bottom plates 34 and 36 at approximately 120 degrees with respect to one another. However, when a person sits on the chair 10 and leans his back against the backrest portion 22, the biasing force of the spring 48 is overcome and the bottom and top plates 34 and 36 are pivoted rearwardly substantially in the plane of the U-shaped frame member 41 to a validation position in which the top and bottom plates 34 and 36 are at 180 degrees with respect to each other. The movement of the top and bottom plates 34 and 36 results in a longitudinal downward displacement of the pins 42 within the guides 44. This downward displacement is used by the actuator 32 to automatically disable the lock 30 and, thus, allow relative movement between the chair body 16 and the fixed base 14, as will be explained hereinafter.

Figure 4:
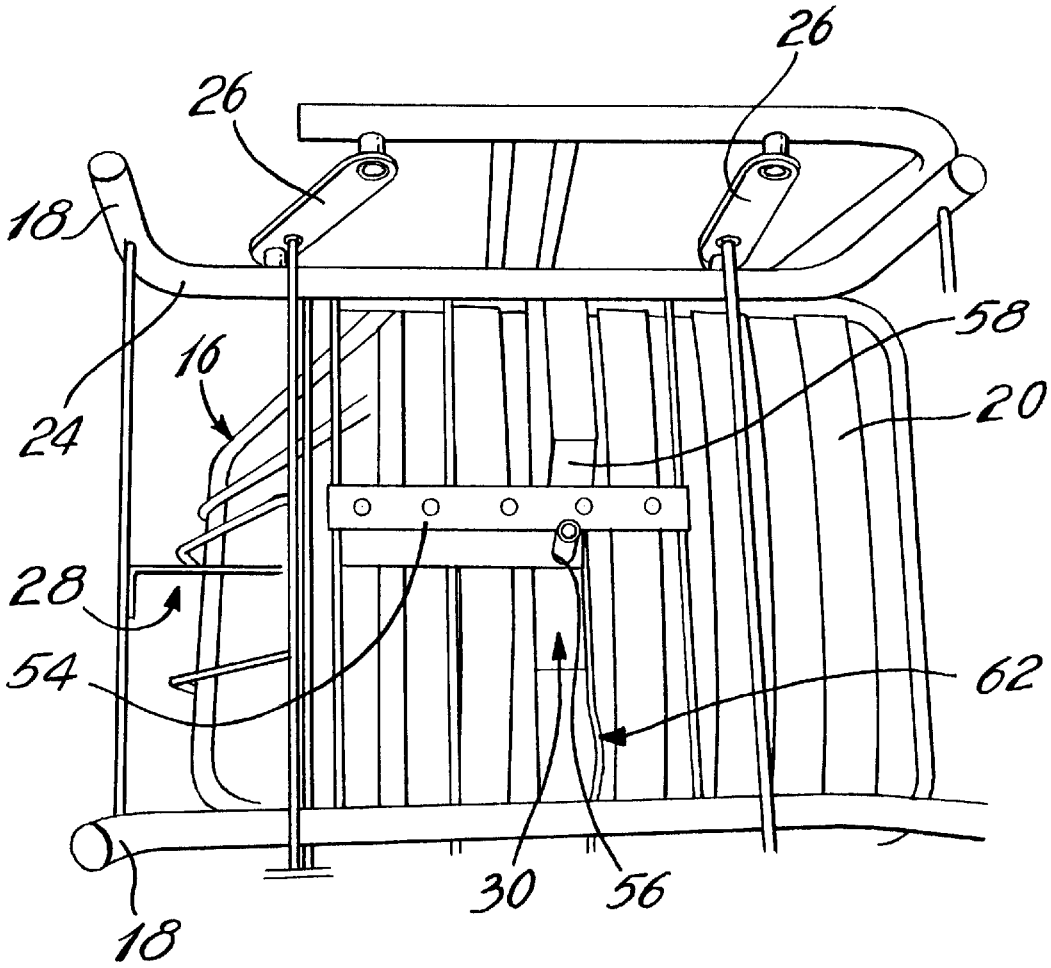
FIG. 4 is a bottom plan view of the underside of the swinging chair illustrating how the same is locked in position through the use of a pivotal latch and a ratchet plate.
Figure 5:
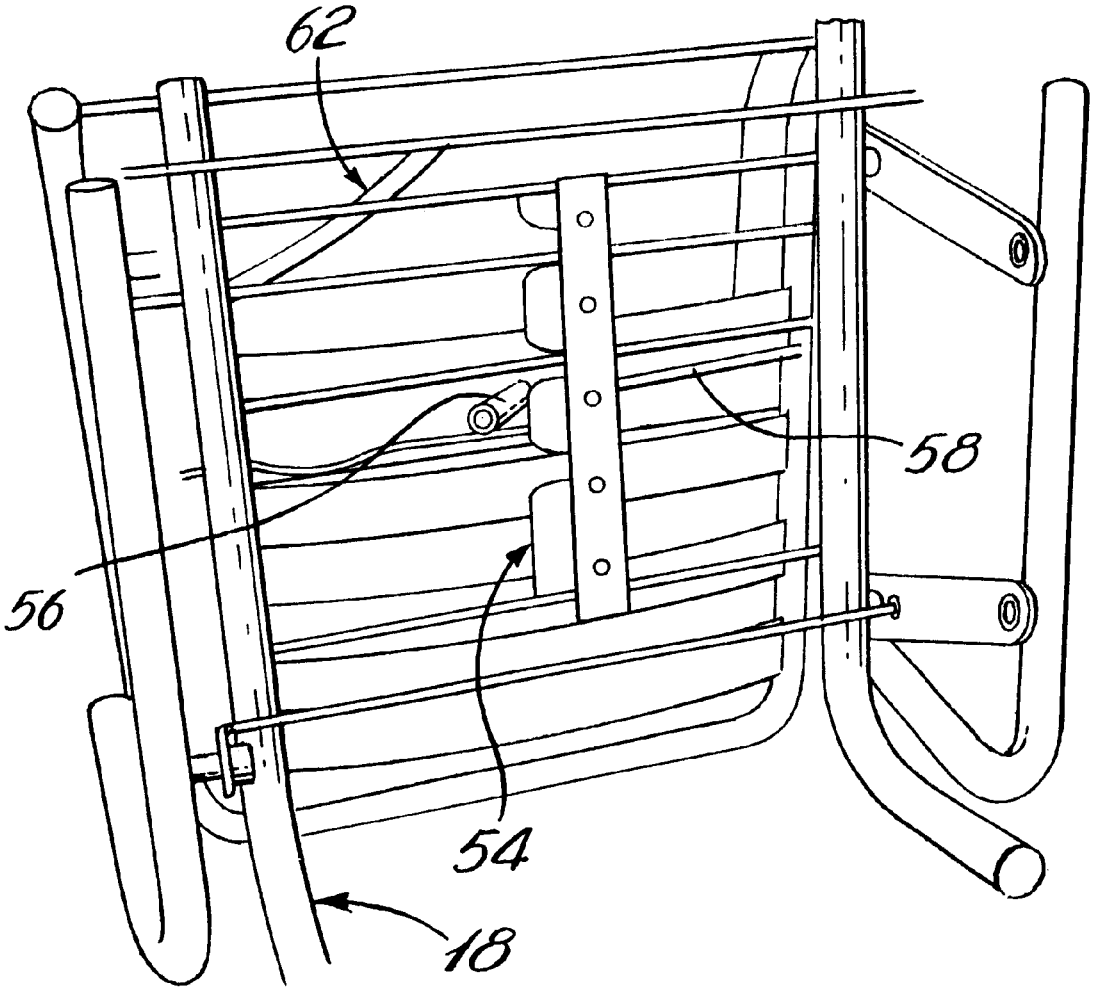
FIG. 5 is a bottom plan view of the underside of the swinging chair illustrating the pivotal latch out of engagement with the ratchet plate to unlock the swinging chair.
Figure 6:
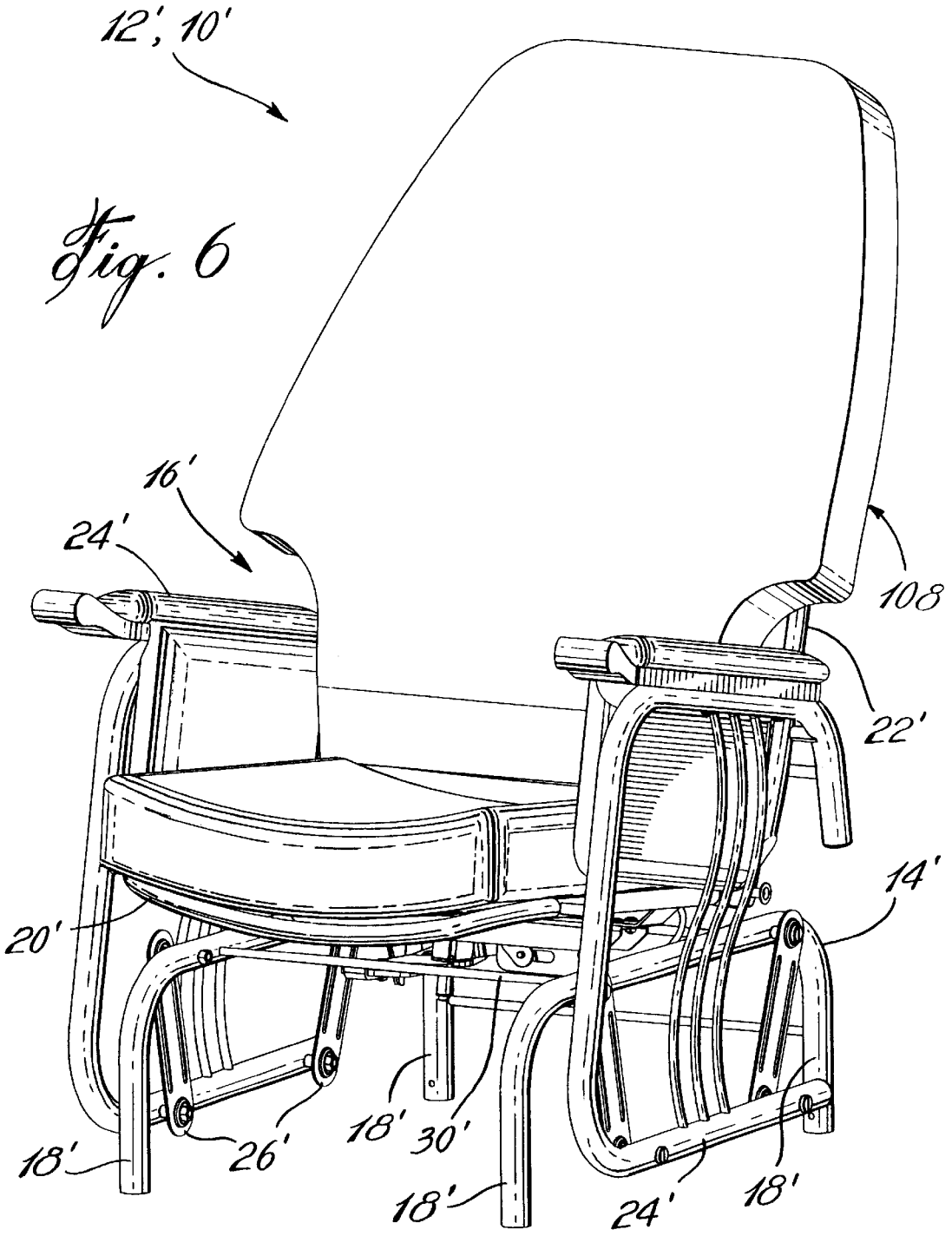
FIG. 6 is a perspective view of a swinging chair with a self-locking mechanism in accordance with a second embodiment of the present invention.

As seen in FIGS. 2, 4 and 5, the lock 30 comprises a catch provided in the form of a ratchet plate 54 rigidly secured to the fixed base 14 and a latch 56 pivotally mounted to the chair body 16. A spring 58 is provided to urge the latch 56 in engagement with the ratchet plate 54 in order to lock the fixed base 14 and the chair body 16 together and, thus, prevent relative movement therebetween. The latch 56 is provided with a tubular covering member 60 which is freely rotatable about the engaging end of the latch 56 so as to minimize the friction with the ratchet plate 54 during disengaging operations.

Figure 3:
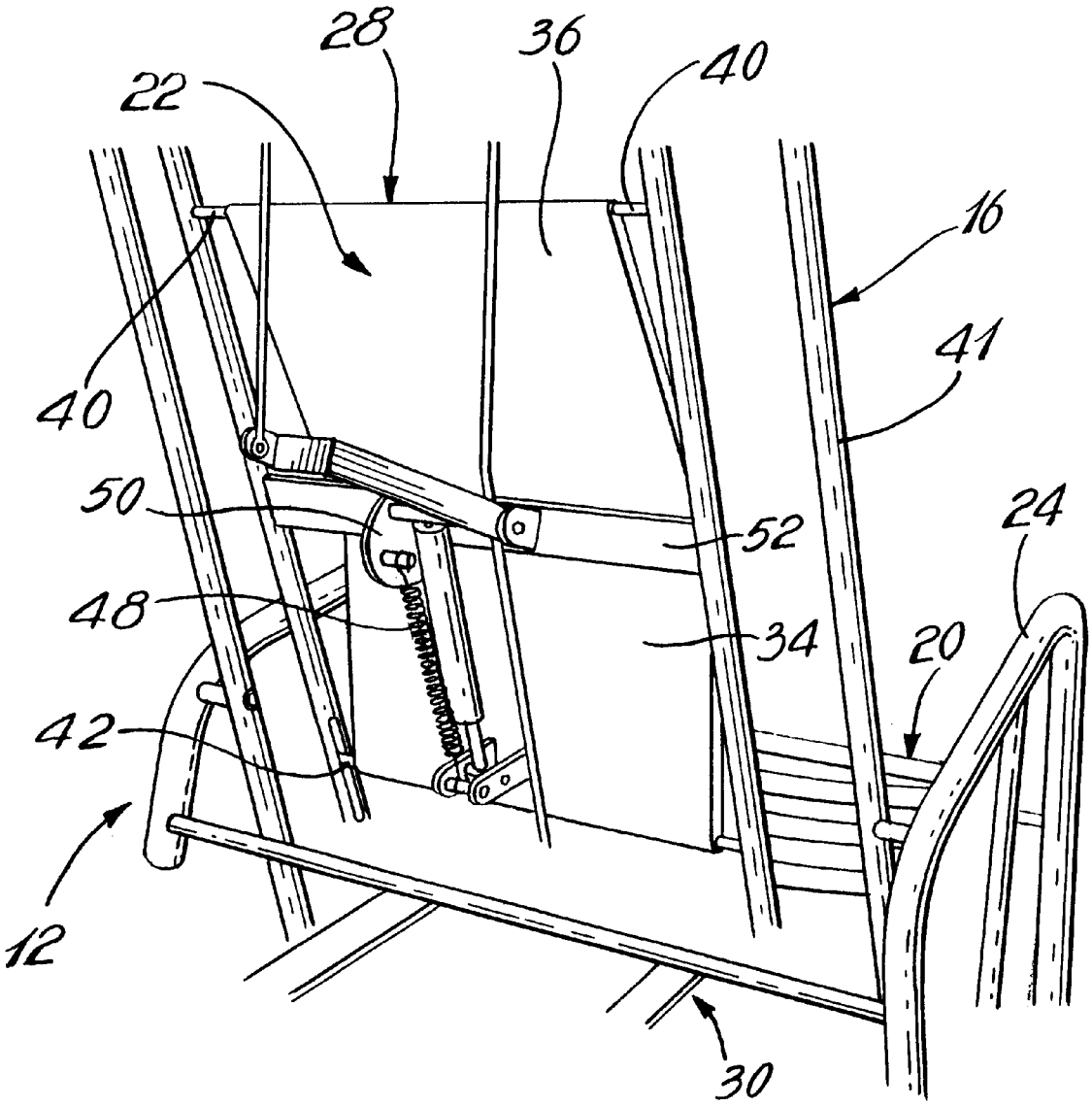
FIG. 3 is a rear elevational view of the backrest portion with the self-locking mechanism shown in an inoperative mode.

The actuator 32 includes a flexible sheathed cable 62 including a core 64 slidably mounted within a surrounding sheath 66. As seen in FIG. 2, the sheath 66 is attached at an upper end 68 thereof to the movable bracket 46. The opposed lower end of the sheath 66 is secured in place at an appropriate point on the chair body 16. The core 64 is attached at a lower end thereof to the pivotal latch 56 and at an upper end 70 thereof to the bottom end of a cylindrical member 72 which is, in turn, pivotally mounted at an upper end 74 thereof to a lever 76. The lever 76 is pivotally mounted to the cross-member 52 for pivotal movement between a lowered position, as seen in FIG. 2, and a raised position (see FIG. 3) wherein the actuation of the lock 30 by the sheathed cable 62 in response of the downward displacement of the bottom plate 34 is inhibited.

When the lever 76 is in its lowered position and the bottom and top plates 34 and 36 are pivoted rearwardly in response of a load applied thereto by the back of an occupant, the resulting downward movement of the bottom plate 34 will be transmitted as a pushing force on the upper end of the sheath 66 via the bracket 46 but since the lower end of the sheath 66 is fixed, this pushing action will be converted in a pulling action on the core 64. This pulling action will act against the biasing force of the spring 58 to pivot and disengage the latch 56 from the ratchet plate 54, thereby automatically allowing the chair body 16 to move with respect to the fixed base 14. However, if the lever 76 is locked in its raised position, then the sheathed cable 62 will be no longer loose and consequently no pulling force will be communicated to the latch 56 via the core 64, whereby the lock 30 will remain in its lock state even though the top and bottom plates 34 and 36 are displaced rearwardly in the plane of the backrest portion 22.

As explained hereinbefore, when the chair 10 is unoccupied, the mobility functions thereof are locked by the lock 30. Therefore, when a person is about to sit on the chair 10, he/she can grasp the armrests 24 to provide support to himself or herself while lowering his/her body onto the chair 10 and that without inducing any movement to the chair body 16. Once the person has lowered his/her buttock on the seat portion 20 of the chair 10, the person can displace his/her weight on the seat portion 20, without inducing any motion thereto, until his/her back reaches the backrest portion 22, i.e. when his/her buttock is supported on a rear half of the seat portion 20. Then, the person can lean his/her back against the backrest 22, thereby actuating the detector 28 and the actuator 32 which, in turn, actuates the lock 30 via the cable 62 to release the mobility functions of the chair 10.

The position, the shape and the operation of the detector 28 and the actuator 32 allow to determine the intent of a chair occupant to leave the chair 10. Indeed, for the type of chair illustrated in FIG. 1, when the occupant decides to stand up, the upper portion of his back first leaves the backrest 22, with his pelvis and buttock remaining stationary on the seat portion 20. According to the first illustrated embodiment, it is with this movement of the upper torso of the occupant's body that the intent of the occupant to rise from the chair is determined. By detecting the intent of the occupant to arise from the chair with the forward shifting movement of the upper torso of the occupant's body, which naturally occurs before an occupant starts to lift his weight from the seat portion 20 of the chair 10, the chair 10 is advantageously stabilized before the occupant takes support thereon to lift himself/herself up. The mobility functions of the chair 10 are indeed automatically locked, while the occupant is still assuming a normal sitting position in the chair 10, i.e. while his buttock is supported at a rear end portion of the seat 20.

In the following description which pertains to the device of FIGS. 6 to 9, components which are identical in function and identical or similar in structure to corresponding components of the first-described embodiment bear the same reference numeral as in FIGS. 1 to 5 but are tagged with the suffix "'", whereas components which are new to the embodiment of FIGS. 6 to 9 are identified by new reference numeral in the hundreds.

Figure 7:
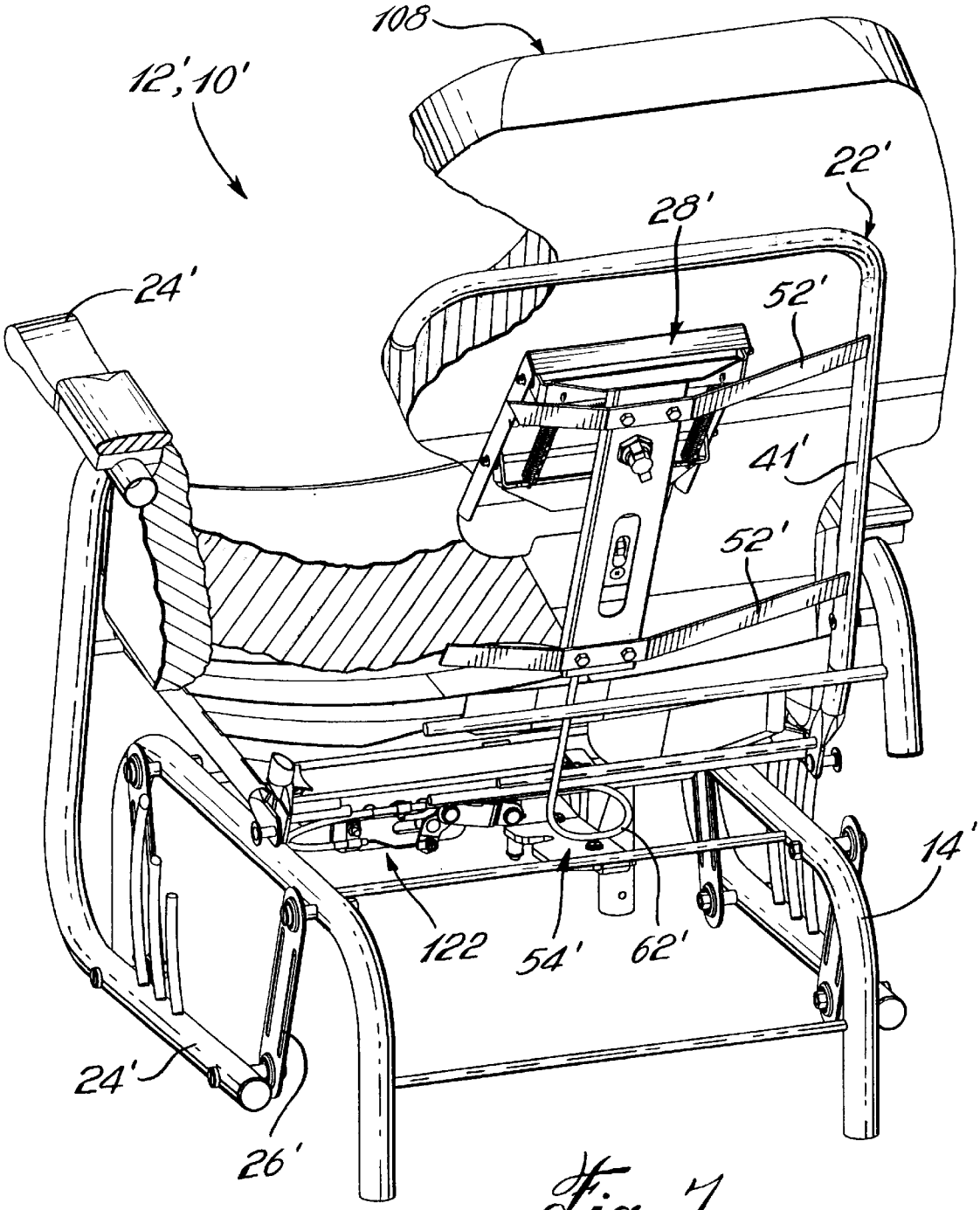
FIG. 7 is a rear perspective view of the chair illustrating how the self-locking mechanism is installed in the backrest portion of the chair.

More specifically, FIGS. 6 to 9 illustrate a second construction of a self-locking mechanism 12' wherein the detector/actuator 28' includes a pushing plate 34' (see FIG. 8) pivotally mounted on a hinge pin 100 extending through a pair of laterally spaced-apart support arms 102 extending forwardly at right angles from a transversal upper end portion 104 of a rail member 106 secured to a pair of spaced-apart cross-members 52' (FIG. 7) extending transversally between the legs of the inverted U-shaped frame member 41' of the backrest portion 22' of the chair body 16'. As shown in FIG. 7, the plate 34' is located under a cushion 108 recovering the backrest portion 22' of the swinging chair 10'. The plate 34' has a rounded lower end portion which allow it to slide under the cushion 108 when a chair occupant leans his back thereagainst. A thin plastic plate (not shown) can be sewn to the back surface of the cushion 108 in alignment with the pressure point on the plate 34' so as to have the same coefficient of friction irrespectively of the material used in the manufacture of the cushion 108.

A pushing arm 110 is pivotally mounted at a first end thereof to a pivot pin 112, which is, in turn, mounted to the plate 34'. The pushing arm 110 is pivotally mounted at a second opposed end thereof to a pivot pin 114 (see FIG. 9) mounted to an actuator 32' confined to slide longitudinally within an elongated stem portion 116 of the rail member 106. The assembly of the rail member 106, the plate 34', the pushing arm 110 and the actuator 32' constitutes a "toggle joint" which is adapted to increase the pushing force of the actuator 32' as the plate 34' pivots towards the rail member 106. The toggle joint allows the chair occupant to feel no pressure on its back when the plate 34' is pivoted towards the rail member 106.

A pair of laterally spaced-apart springs 118 extends between the pushing arm 110 and the rail member 106 to normally bias the plate 34' away from the rail member 106. Accordingly, when the back of the occupant leaves the cushion 108, the plate 34' automatically pivots back to its original position, as illustrated in FIG. 7.

Figure 9:
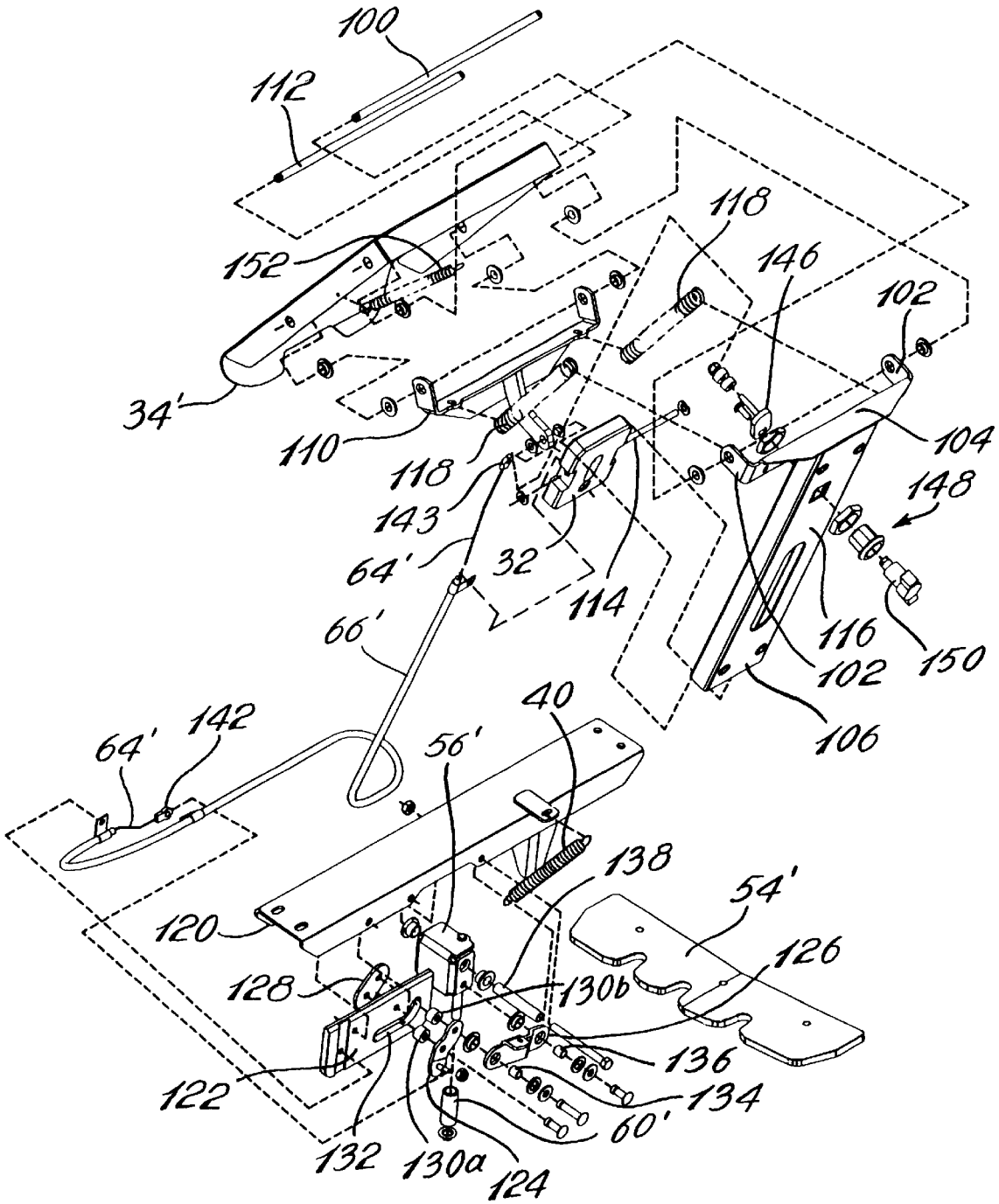
FIG. 9 is an exploded perspective view of the self-locking mechanism.

The self-locking mechanism 12' also comprises a lock 30'. The lock 30' includes a notched plate 54' rigidly secured to the fixed base 14' and a pivotal latch 56' pivotally mounted to a transversal rail 120 secured to the undersurface of the seat portion 20'. The lock 30' further includes a slotted block 122 adapted to be secured to the transversal rail 120, a mobile lever 124 engaged with the slotted block 122 and a link 126 connecting the mobile lever 124 to the latch 56'. As illustrated in FIG. 9, the mobile lever 124 is assembled to a retaining plate 128 through a pair of bushings **130*a* and 130*b*. The slotted block 122 is sandwiched between the mobile lever 124 and the retaining plate 128 with the bushings 130*a* and 130*b* extending through a L-shaped slot 132 defined in the slotted block 122. The bushings 130*a* and 130*b* are thus constrained to move within the L-shaped slot 132. The link 126 is pivotally mounted at a first end thereof to a pivot 134 extending through the bushing 130*b*, thereby allowing the pivot of the lever 124 relative to the link 126. The link 126 is pivotally mounted at a second opposed end thereof on a pivot 136 mounted to the latch 56' to allow the link 126 to pivot with respect to the latch 56'. The latch 56' is, in turn, pivotally mounted on a pivot 138 extending from the transversal rail 120. A spring 140 has a first end thereof attached to the transversal rail 120 and a second opposed end thereof to the link 126 to normally bias the latch 56' in locking engagement with the notched plate 54'. The latch 56' is provided with a tubular covering member 60' which is freely rotatable about the engaging end of the latch 56' so as to minimize the friction with the notched plate 54'**.

The self-locking system 12' further includes a control cable provided in the form of a flexible sheathed cable 62' having a core 64' slidably mounted within a surrounding sheath 66'. A first end of the sheath 66' is fixed to the actuator 32' while the other end thereof is fixed to the slotted block 122. The core 64' has a first end 142 fixed to the lever 124 and a second opposed end 143 to an arm 146 rotatably mounted to the rail member 106 to form part of a state selection assembly 148 operable to disable the self-locking system 12', as will be explained hereinbelow.

Figure 8:
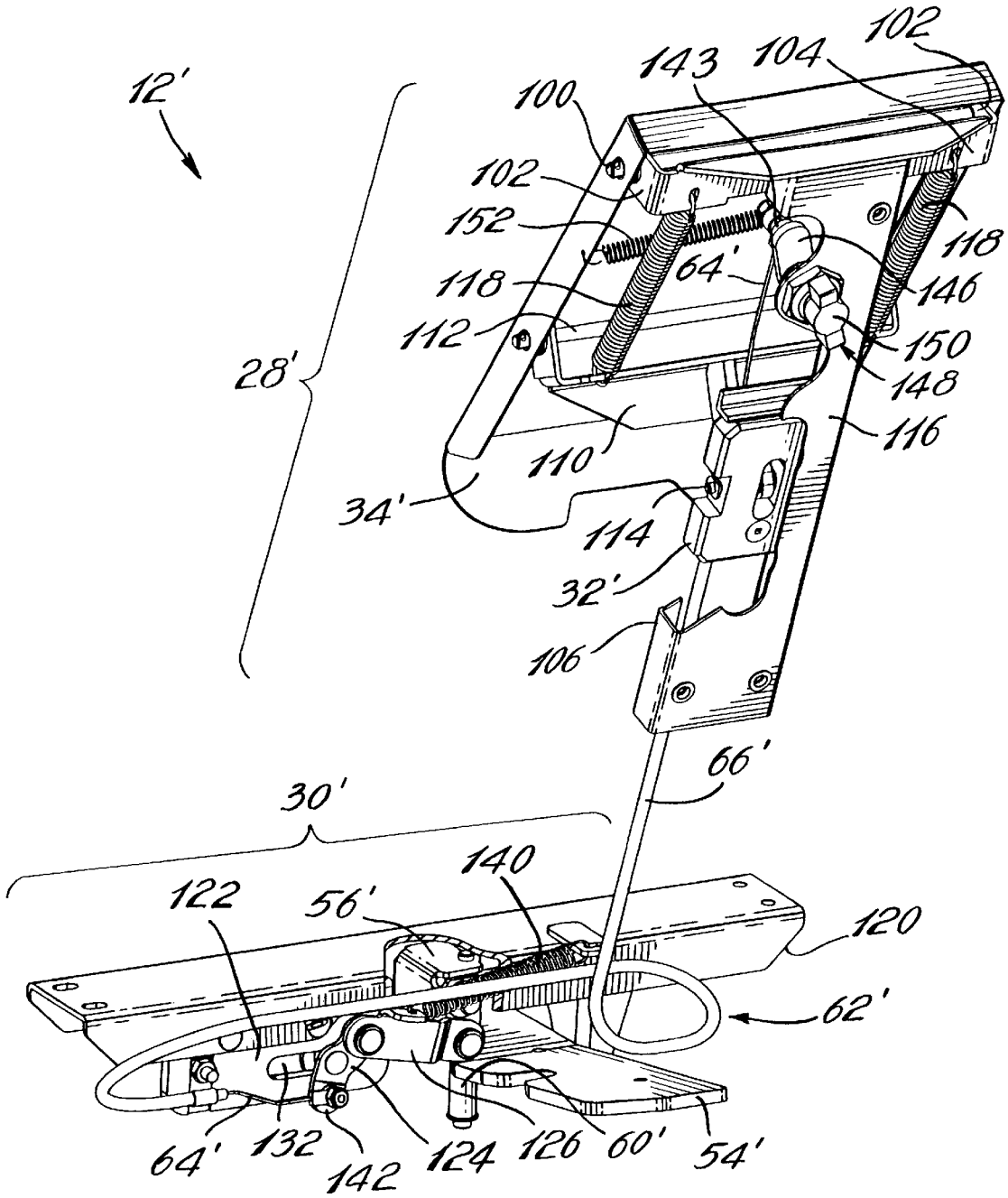
FIG. 8 is a perspective view of the self-locking mechanism alone.

When a pressure is applied on the plate 34' the latter pivots towards the rail member 106, thereby displacing the pushing arm 110. The displacement of the pushing arm 110, in turn, causes the actuator 32' to longitudinally slide within the elongated stem portion 116 of the rail member 106. This displacement of the actuator 32' and thus the associated displacement of the end of the sheath 66' that is secured thereto creates a displacement of the core 64' within the sheath 66'. Since the sheath 66' cannot be longitudinally compressed, the pushing action of the sheath 66' will be converted in a pulling action on the upper end 143 of the core 64' and as the second end of the sheath 66' is fixed to the slotted block 112, the lower end 142 of the core 64' will draw the mobile lever 124 to unlock the lock 30. When the core 64' pulls the mobile lever 124, the bushings **130*a* and 130*b* will slide within the L-shaped slot 132 of the slotted block 122. As will be explained hereinafter, the "L" shape of the slot 132 allows to prevent the latch 56' from pivoting away from the notched plate 54' when no pulling action is exerted on the lever 124. Indeed, when there is no tension in the core 64', the spring 140 acts on the link 126 to maintain the bushing 130*b* at the end of the upper angled segment of the L-shaped slot 132, as illustrated in FIG. 8. In this position, it is impossible to unlatch the latch 56 by acting directly thereon. Indeed, if a force is applied on the tubular covering member 60' with a view of pivoting the latch 56' away from the notched plate 54', the link 126 will block the movement of the latch 56' because the bushing 130*b* to which the link 126 is pivotally mounted is urged in the upper angled portion of the slot 132 by the spring 140. The only way of unlocking the lock 30 is to actuate the core 64' of the control cable so as to pull on the lever 124 to displace the bushing 130*b* out of the upper angled segment of the L-shaped slot 132 and, thus, draw the link 126 which will, in turn, cause the latch 56' to pivot away from the notched plate 54', thereby allowing the chair body 16' to swing relative to the base 14'**.

The state selection assembly or disabling mechanism 148 is adapted to change the position of the upper end 143 of the core 64' to selectively disable the self-locking system 12'. The state selection assembly 148 essentially comprises a knob-like member 150 operatively connected to the arm 146 for manually rotating the same between first and second positions. A spring 152 is fixed at one end to the plate 34' and at the other end thereof to the arm 146 to maintain the arm 146 in either one of the first and second positions. When the position selected is as illustrated in FIG. 8, the self-locking system 12' is operational. However, if the knob 150 and the arm 146 are rotated to the second position thereof so as to displace the upper end 143 of the core downwardly, then a sufficient length of the core cable becomes loose such that subsequent actions of the actuator 32' will have no effect on the lever 124 of the lock 30'. This allow to keep the chair in a lock state even though a person is sitting in the chair 10'.

Although the present invention has been described in the context of a swinging chair, it is understood that it could also be used in the context of other mobile chairs, such has swiveling chair, wheel chair, rocking chair or even seats of a motorized vehicle. For instance, in the case of a wheel chair, the above described lock 30/30' could be simply replaced by a pair of brakes capable of locking against respective rims of the wheels. The term chair is understood herein to mean any types of support upon which someone may sit.

It is also understood that the detector 28 and the detector/actuator 28' could be provided at other locations than the backrest portion 22/22' of the chair. For instance, the detector could be related to the armrests or the seat portion of the chair. It is also contemplated to use different types of detectors, such as sensors. A system responsive to the change of position of the center of gravity of a person sitting on a chair could also be used. Electronic or electric systems using capacitive detectors, load-cells, infra-red or other type of detecting devices could be used as well. A pneumatic system or a hydraulic system could also be placed in the backrest portion or the seat portion of a chair to detect a change of weight or a change in the position of the center of gravity of the person sitting on the chair to command the locking of the mobility functions of the chair.

More particularly, it is contemplated to provide capacitive detectors, photo-electric cells or other type of detecting devices in the backrest of a chair to detect the intent of an occupant to stand up by detecting the fact that the occupant's back is gradually moving away from the backrest of the chair. An electronic or electric system could be used to release the locking mechanism once the forward shifting motion of the upper torso of the occupant has been detected.

Alternatively, the seat of the chair could be placed on a central pivot transversal to the chair and with the help of a pair of load cells, a continuous measure of the occupant's weight could be done by an electric or electronic control system. If the control system detects a substantial weight transfer towards the front of the chair, or a sudden drop of weight of more than 50% between two successive readings, the system could command the locking of the mobility functions of the chair. The system could also include upper and lower predetermined thresholds. A weight transfer evaluating system could even be formed of levers and springs.

Sensors, hydraulic or pneumatic systems could also be used to detect a pressure on the armrests of the chair in conjunction with a reduction of the pressure on the backrest or the seat portion of the chair to determine the intent of the occupant to rise from the chair.

As to the lock system, it is understood that it could be provided in the form of a friction brake. Alternatively, a ratchet bar fixed to the mobile part of the chair and which is engageable with an anchoring point fixed on the base of the chair could be used. Any other mechanical locking or blocking system could be used as well.

The actuator could also be provided in the form of an electromagnetic coil or solenoid. Finally, the actuator could consists of a pneumatic or hydraulic system.

What is claimed is:

1. A self-locking system in combination with a mobile chair of the type having a seat, said self-locking system comprising a lock mounted to said chair and displaceable between idle and functional positions for selectively locking the chair against movement, and a state selector operatively connected to said lock for detecting the intent of an occupant to rise from the chair and then automatically causing said lock to move to said functional position thereof, wherein said state selector is actuated by a movement of an upper portion of the body of the occupant while the occupant is still supported in a normal seated position on the seat of the chair, wherein once actuated, said state selector transmits a force to said lock to displace said lock to said functional position, thereby allowing the chair to lock in a stationary position before the occupant starts to lift his weight from the seat of the chair.

2. A combination as defined in claim 1, wherein said state selector includes an actuator engageable with said lock to automatically cause said lock to move to said idle position thereof in response to a movement of the upper portion of the occupant's body after the occupant has positioned his buttock on a rear half portion of the seat of the chair.

3. A combination as defined in claim 2, wherein said state selector includes a detector operatively connected to said actuator, said detector being sensitive to a change of pressure resulting from a movement of an upper portion of the body of the occupant while the weight of the occupant is still supported on the seat.

4. A combination as defined in claim 3, wherein said actuator is effective to cause said lock to move to said functional position thereof in response to a detection by said detector of a forward shifting movement of the upper torso of the occupant's body while the weight of the occupant is still supported on the seat of the chair.

5. A combination as defined in claim 4, wherein said detector is adapted to be placed in a backrest portion of the chair so as to be responsive to a pressure applied to the backrest portion by the occupant's back.

6. A combination as defined in claim 5, wherein said detector includes a spring-loaded pivotal member adapted to be pivoted against a biasing force thereof to a validation position in response to a load applied thereto by the occupant's back.

7. A combination as defined in claim 6, wherein said actuator is movable by said spring-loaded pivotal member to displace said lock to said idle position thereof in response to a pivotal movement of said spring-loaded pivotal member to said validation position thereof.

8. A combination as defined in claim 7, wherein said actuator includes a pushing member linked to said spring-loaded pivotal member so as to be slidably movable thereby, and wherein said lock includes a spring-loaded latch and a catch, said latch being engageable with said catch to lock the mobility functions of the chair, said spring-loaded latch being movable by said pushing member against a biasing force from said functional position to said idle position.

9. A combination as defined in claim 8, wherein said pushing member is connected to said latch via a control cable.

10. A combination defined in claim 9, further comprising a lock disabling mechanism displaceable between a first position wherein said self-locking system is operational and a second position wherein said self-locking system is disabled, and wherein said control cable includes a core slidably mounted within a sheath, said sheath having a first end secured to said pushing member and a second end thereof secured to a fixed member, said core having a first end attached to said disabling mechanism and a second opposed end attached to said latch.

11. A combination as defined in claim 1, wherein said lock includes a pivotal latch engageable with a catch, a lever having first and second axles extending perpendicularly thereto for movement in an L-shaped slot, a link pivotally connected at a first end thereof to said second axle and at a second end thereof to said pivotal latch, biasing means to normally urge said latch in engagement with said catch and said second axle in an angled segment of said L-shaped slot, said state selector being adapted to exert a force on said lever to first cause said lever to pivot about said first axle thereof and then slide to pivot said latch out of said catch, wherein while said latch is urged in engagement with said catch, said second axle cooperates with said angle segment of said L-shaped slot to block movement of said link in response to a force applied to said pivotal latch about an axis of rotation thereof.

* * * * *